US006848690B1

(12) United States Patent
Hunter

(10) Patent No.: US 6,848,690 B1
(45) Date of Patent: Feb. 1, 2005

(54) SEAL FOR HEAD GASKETS OF INTERNAL COMBUSTION ENGINES

(76) Inventor: Ryan Hunter, 2808 West Ave. N-8, Palmdale, CA (US) 93551

( * ) Notice: Subject to any disclaimer, the term of this patent is extended or adjusted under 35 U.S.C. 154(b) by 22 days.

(21) Appl. No.: 10/300,430

(22) Filed: Nov. 19, 2002

(51) Int. Cl.[7] ..... F02F 11/00
(52) U.S. Cl. ..... 277/594; 277/596
(58) Field of Search ..... 277/592–598, 277/590, 591

(56) References Cited

U.S. PATENT DOCUMENTS 3,794,333 A * 2/1974 Czernik et al. ..... 277/593
3,930,656 A * 1/1976 Jelinek ..... 277/611
4,272,085 A * 6/1981 Fujikawa et al. ..... 277/594
4,778,189 A * 10/1988 Udagawa ..... 277/648
4,828,275 A * 5/1989 Udagawa ..... 277/596
5,322,299 A * 6/1994 Terai ..... 277/596
5,615,898 A * 4/1997 Clark et al. ..... 277/596
5,890,719 A * 4/1999 Bettencourt ..... 277/599
6,318,733 B1 * 11/2001 Udagawa ..... 277/596

FOREIGN PATENT DOCUMENTS

JP 58081269 A * 5/1983 ..... F16J/15/20

* cited by examiner

*Primary Examiner*—Robert J. Sandy
*Assistant Examiner*—Vishal Patel
(74) *Attorney, Agent, or Firm*—Dennis W. Beech

(57) ABSTRACT

The seal for the head gaskets of internal combustion engines may be a bead seal of material that may be elastic, resistant to compression and deformable under pressure. The bead seal may be attached around the holes in a malleable copper head gasket on each side of the head gasket. The bead seals on each side of a selected hole may be at different distances from the hole.

9 Claims, 2 Drawing Sheets

SEAL FOR HEAD GASKETS OF INTERNAL COMBUSTION ENGINES

BACKGROUND OF THE INVENTION

This invention relates to seals for passages between the cylinder block and the cylinder head for internal combustion engines. The new seal enhances the use of copper head gaskets with deformable bead seals for sealing between cylinder blocks and cylinder heads.

Automobile engines have been modified to produce engine combustion pressures that cause blown head gaskets when using the standard composite or sandwich type cylinder head gaskets. One solution to this problem for high performance engines has been the use of annealed sheet copper for the head gasket material. The copper material conducts heat and can tolerate higher temperatures. It also has high tensile strength, good elasticity and malleability for use in sealing surfaces. The use of a copper head gasket normally includes use of a wire O-ring inserted in a groove cut in the engine block around the cylinder bore.

While copper head gaskets have been shown to be effective for combustion sealing, they may be prone to leak coolant and oil. Currently a sealant may be applied to both sides of the head gasket from either a tube or spray can. However, use of applied sealants has not been found to be effective for sealing fluid passages.

There is a need for an effective seal for combustion pressure around the cylinder bore as well as sealing of passages through which liquids such as coolant and oil pass. In use of copper head gaskets it may be important that the head gasket be structured for ease of installation as improper application of sealants may produce a poor seal.

SUMMARY OF THE INVENTION

The present invention is directed to seals for the head gaskets of internal combustion engines. A bead seal of material may be elastic, resistant to compression and deformable under pressure. The bead seal may be attached around the holes in a malleable copper head gasket on each side of the head gasket. The bead seals on each side of a selected hole or aperture may be at different distances from the aperture.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
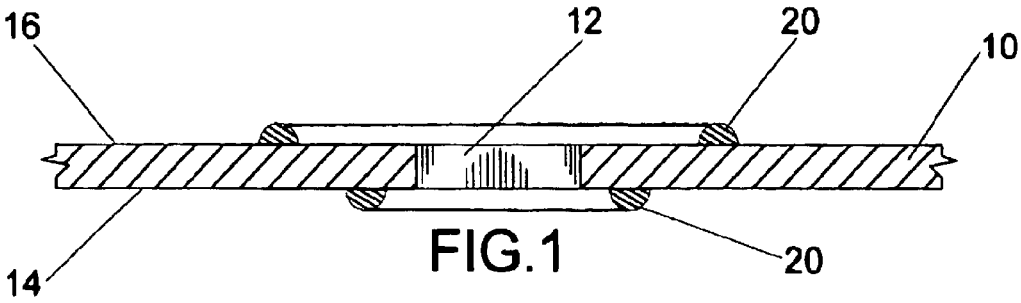
FIG. 1 illustrates a partial side elevation cross-sectional view of a head gasket with bead seals according to an embodiment of the invention.
Figure 2:
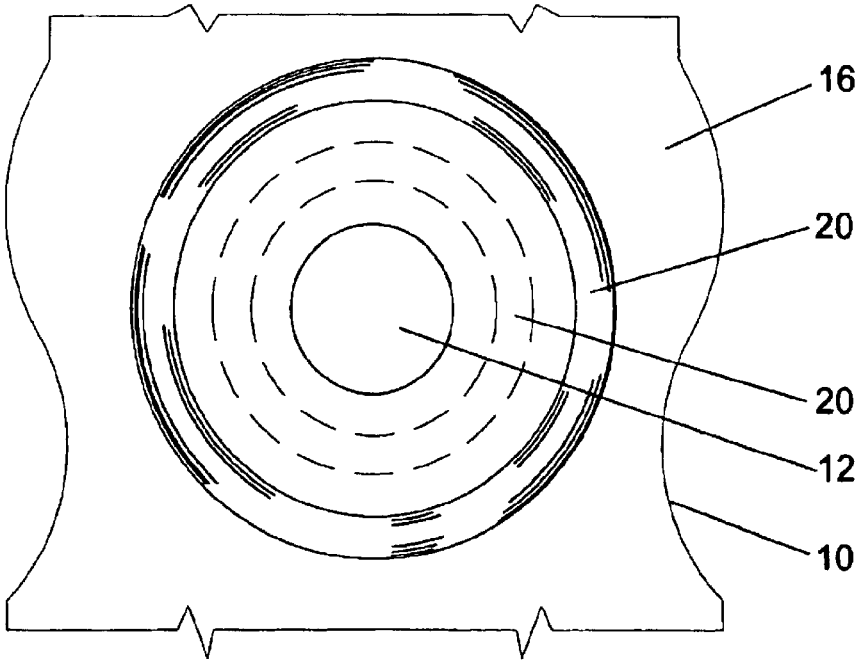
FIG. 2 illustrates a partial top plan view of a head gasket with bead seals according to an embodiment of the invention.
Figure 3:
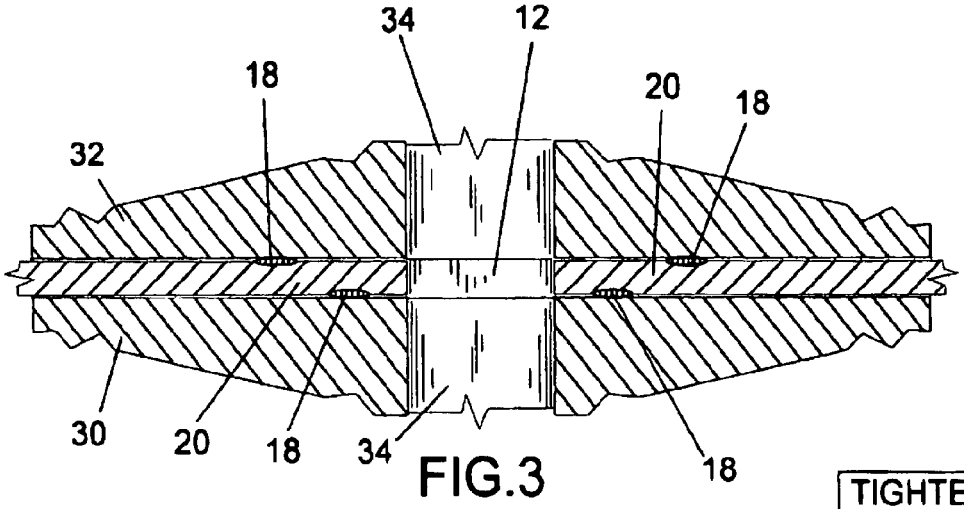
FIG. 3 illustrates a partial side cross-sectional view of a head gasket, cylinder block and cylinder head according to an embodiment of the invention.
Figure 4:
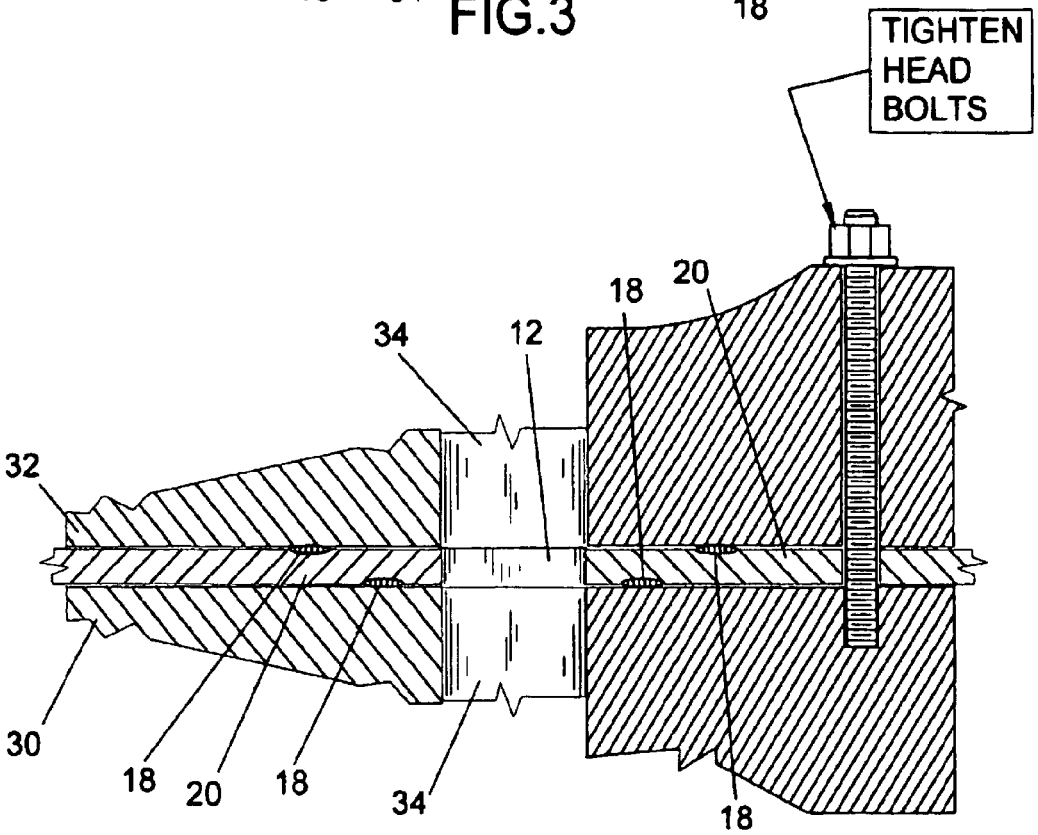
FIG. 4 illustrates a partial side cross-sectional view of a head gasket, cylinder block, head bolt and cylinder head according to an embodiment of the invention.

Referring to FIGS. 1 and 2, a seal for a head gasket 10 may be a bead seal 20 attached around selected apertures 12 of the head gasket 10. These apertures 12 may provide for passage of fluids such as oil and coolant between an internal combustion engine cylinder block 30 and cylinder head 32 through fluid passage 34, see FIG. 3.

The bead seal 20 may be formed from a material that may be elastic, resistant to compression and deformable under pressure. The bead seal 20 material may also be selected for ease of attachment to an annealed copper head gasket 10. The bead seal 20 material may be solid silicone, flouroelastomer or like material. The bead seal 20 may be elastic, also known as having memory, to maintain a force against sealing surfaces when pressure is applied. An example of a silicone material is T-4 Silicone manufactured by Wacker Chemical Company.

It has been found by experiment that a bead seal 20 may be approximately 0.030 inches to 0.050 inches in width and approximately 0.003 inches to 0.008 inches in height for a typical head gasket application. The use of two offset bead seals 20 may also be used to aid localized clamp load at the wire o-ring that may be used to seal gas combustion pressure in the cylinders.

A bead seal 20 may be applied to the cylinder block side 14 and the cylinder head side 16 of the head gasket 10. The distance of each opposing bead seal 20 from the aperture 12 may be different as illustrated in the figures. This may produce a horizontal offset between the two bead seals 20. The amount of offset may vary according to the thickness of the head gasket 10. The offset distance may be larger for thicker head gaskets 10 to facilitate deformation of the head gasket 10.

The bead seal 20 may be roughed to improve sealing qualities. The copper head gasket may be textured on its surface to improve attachment of the bead seal 20.

Referring to FIG. 1 through 4, as the head bolts of the engine are tightened during installation of the head gasket 10, the bead seals 20 may be deformed and pressed into the copper head gasket 10 between the cylinder block 30 and cylinder head 32. The malleable copper may deform to form a trough 18 in the head gasket 10. The trough 18 may limit the amount of deformation of the bead seal 20. The offset between the bead seal 20 may allow the soft copper head gasket 10 to bend between the bead seal 20 to form a containment trough as the troughs 18 are formed at the bead seal 20 locations.

The offset distance between the bead seal 20 may facilitate the high clamp load required at the wire o-ring (not shown); whereas, if the bead seals 20 were not offset, additional clamp load would have to be applied to deform the bead seals 20 to allow proper clamp load at the o-ring for a proper combustion chamber gas seal.

While the invention has been particularly shown and described with respect to the illustrated embodiments thereof, it will be understood by those skilled in the art that the foregoing and other changes in form and details may be made therein without departing from the spirit and scope of the invention.

What is claimed is:

1. A seal for the head gasket of internal combustion engines comprising:

a bead seal of material that is elastic, resists compression and deforms under pressure; and a malleable copper head gasket having a plurality of apertures wherein for each selected aperture;

a first bead seal is attached to the malleable copper head gasket on a first planar surface around said selected aperture on a cylinder block side at a first distance from said selected aperture;

a second bead seal is attached to the malleable copper head gasket on a second planar surface around said selected aperture on a cylinder head side at a second distance from the selected aperture; and upon compression of said malleable copper head gasket between a cylinder block and a cylinder head, said malleable copper head gasket deforms creating a trough in said first planar surface and said second planar surface at each of said first bead seal and said second bead seal positions.

2. The seal as in claim 1 wherein said bead seal is roughened for improved sealing properties.

3. The seal as in claim 1 wherein said bead seal material is a solid silicone.

4. The seal as in claim 1 wherein said bead seal material is a flouroelastomer.

5. The seal as in claim 1 wherein said bead seal is approximately 0.030 inches to 0.050 inches width and approximately 0.003 inches to 0.008 inches in height.

6. The seal as in claim 1 wherein said first distance and said second distance are different.

7. The seal as in claim 1 wherein upon compression of said malleable copper head gasket between a cylinder block and a cylinder head, said malleable copper head gasket deforms creating a trough at each of said first bead seal and said second bead seal positions.

8. A method for head gasket sealing of passages between the cylinder block and the cylinder head of internal combustion engines, comprising the steps of:

providing a bead seal of material that is elastic, resists compression and deforms under pressure;

attaching a first bead seal to a malleable copper head gasket on a first planar surface around a selected aperture on a cylinder block side at a first distance from said selected aperture;

attaching a second bead seal to said malleable copper head gasket on a second planar surface around said selected aperture on a cylinder head side at a second distance from said selected aperture;

placing said malleable copper head gasket between a cylinder block and a cylinder head;

attaching said cylinder block to said cylinder head by tightening a plurality of head bolts sufficiently to deform said bead seals and to create a trough on said first planar surface and said second planar surface in said malleable copper head gasket at said bead seal positions.

9. The method as in claim 8 wherein said first bead seals and said second bead seals are approximately 0.030 inches to 0.050 inches in width and approximately 0.003 inches to 0.008 inches in height.

* * * * *